United States Patent [19]

Bozick

[11] Patent Number: 4,563,829

[45] Date of Patent: Jan. 14, 1986

[54] SHOOTING BENCH

[76] Inventor: Thomas J. Bozick, 5485 Carbon Hill Rd., East Palestine, Ohio 44413

[21] Appl. No.: 619,572

[22] Filed: Jun. 11, 1984

[51] Int. Cl.[4] ..... F41C 29/00

[52] U.S. Cl. ..... 42/94

[58] Field of Search ..... 42/94; 89/37.04

[56] References Cited

U.S. PATENT DOCUMENTS

| | | | |
|---|---|---|---|
| 1,740,561 | 12/1929 | Bair | 42/94 |
| 2,877,689 | 3/1959 | Pribis | 89/37.04 |
| 3,125,929 | 3/1964 | Peasley | 89/37.04 |
| 3,361,265 | 1/1968 | Wernimont | 42/94 |
| 3,608,225 | 9/1971 | Manuel | 42/94 |
| 3,711,984 | 1/1973 | Dyer et al. | 42/94 |
| 3,947,988 | 4/1976 | Besaw | 42/94 |
| 4,506,466 | 3/1985 | Hall | 42/94 |

*Primary Examiner*—Charles T. Jordan

*Attorney, Agent, or Firm*—Harpman & Harpman

[57] ABSTRACT

A shooting bench for use with hand guns, such as target pistols, positions an elongated horizontally disposed flat body member on the upper end of a vertical support and detachably secures a triangular secondary vertical support thereto. A hinged block having a padded V-shaped depression in its upper end is attached to one end of the elongated horizontally disposed flat body member and a flat cushion is attached to the flat body member in oppositely disposed relation to the hinged block. The triangular secondary vertical support is positioned at right angles to the first mentioned vertical support and adjustable legs extend downwardly from each of the lowermost portions of the vertical support and the triangular secondary vertical support.

5 Claims, 5 Drawing Figures

SHOOTING BENCH

BACKGROUND OF THE INVENTION

1. Technical Field

This invention relates to shooting benches of the type employed by target shooters.

2. Description of the Prior Art

Prior structures of this type are best illustrated in U.S. Pat. Nos. 1,740,561, 3,608,225, 3,711,984 and 3,947,988.

The coaching and aiming apparatus for firearms of U.S. Pat. No. 1,740,561 discloses a vertically standing structure, portions of which are embedded in the ground for stability. A pair of fulcrum blocks are pivotally mounted to vertical rods in the apparatus and arranged to receive and support firearms.

The shooting bench of the present disclosure arranges a pair of vertical supports at right angles to one another so that the triangular shape of one of the vertical supports lends body and stability to the other and insures the complete stability and positioning of an elongated horizontally disposed flat body member to which a hinged block having a V-shaped depression in its upper end is secured to provide a firm fixed fulcrum for a hand gun positioned thereacross.

U.S. Pat. No. 3,608,225 discloses an elongated base with a pair of vertical rods positioned inwardly of one end thereof and extending upwardly therefrom. A barrel support member is movably positioned on the rods and spring urged detents in the barrel support engage opposing notches in the vertical rods.

In the present invention, the elongated horizontally disposed flat body member which supports the hinged notched block on which the barrel of the fire arm is positioned is solidly and substantially immovably affixed to the vertical support and the triangular secondary vertical support at a fixed elevation with respect thereto.

In U.S. Pat. No. 3,711,984 a portable collapsible shooting bench is disclosed which incorporates a seat member as an essential part of the shooting bench, the seat member being movable from one side of the actual shooting bench to the other. A gun rest is adjustably secured to the bench portion of the device and is provided with a pad on which the barrel of the firearm may be positioned. The present invention utilizes a substantially improved structural member firmly and securely hingedly affixed to the shooting bench and on which the barrel of the firearm may be fulcrumed with no possibility of unwanted movement or accidental repositioning of the gun rest as is possible with the device of U.S. Pat. No. 3,711,984.

U.S. Pat. No. 3,947,988 discloses a portable rifle rest in which a pair of blocks support a rifle support block positioned crossways thereof. A V-shaped notch in the upper surface of the rifle support block is cushioned and arranged to engage the barrel of a rifle to support the same. There is no comparable structure in the present disclosure with the exception of the V-shaped padded notch in the hinged block of the present shooting bench.

DESCRIPTION OF THE PREFERRED EMBODIMENT

Figure 1:
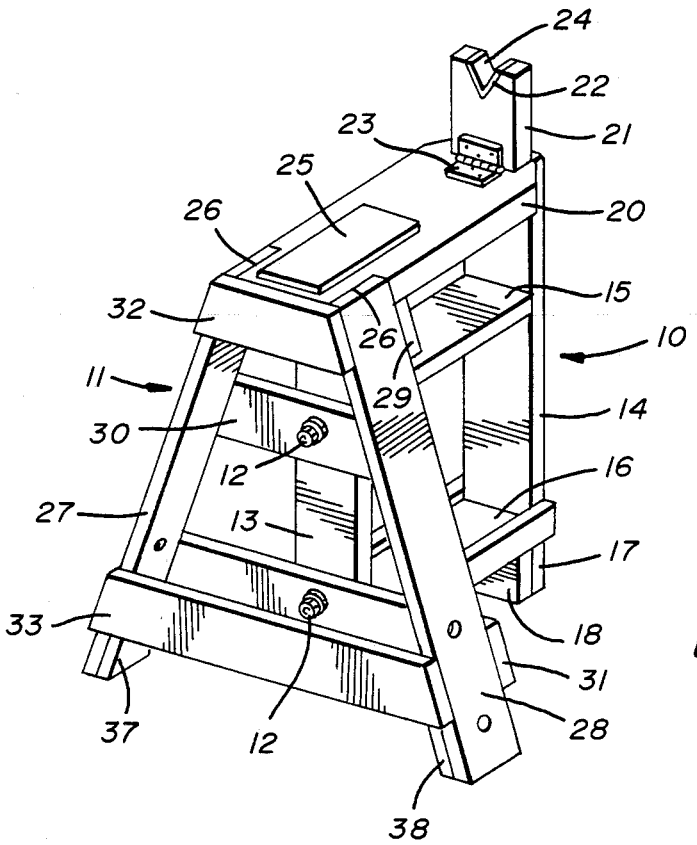
FIG. 1 is a perspective view of the front and one side of the shooting bench.
Figure 2:
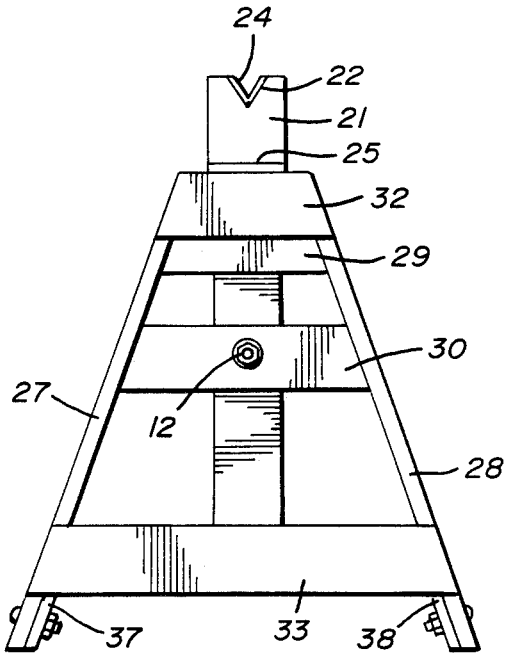
FIG. 2 is a front elevation thereof.
Figure 3:
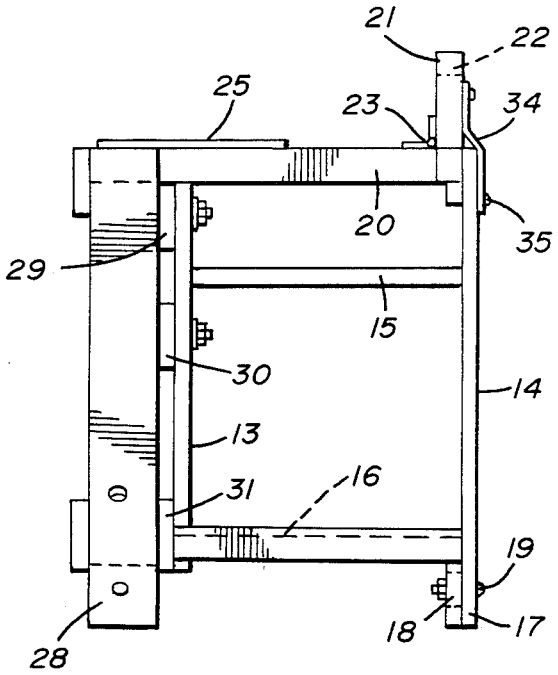
FIG. 3 is a side elevation thereof.
Figure 4:
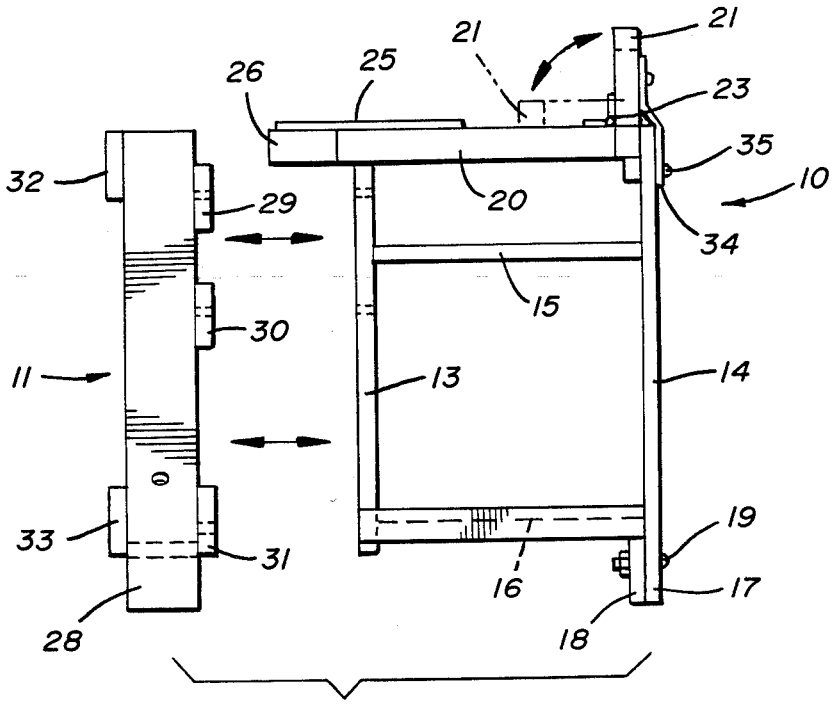
FIG. 4 is an exploded side elevation of the shooting bench.

In the form of the invention disclosed herein and as best illustrated in FIGS. 1,2 and 3 of the drawings, the shooting bench comprises a pair of vertical supports generally indicated at 10 and 11 respectively, which are detachably secured to one another by a plurality of nut and bolt assemblies 12. The vertical support 10 comprises a pair of vertically positioned horizontally spaced elongated frame members 13 and 14 respectively, a pair of horizontally positioned vertically spaced frame members 15 and 16 respectively are affixed to the frame members 13 and 14 respectively. The frame member 14 extends below the horizontal frame member 16 to form a leg portion 17 and an adjustable leg extension 18 is secured thereto by a nut and bolt assembly 19. A horizontally disposed flat body member 20 which forms the top of the shooting bench is affixed to the upper ends of the frame members 13 and 14 respectively with one end of the same extending outwardly beyond the frame member 13 as best seen in FIG. 4 of the drawings. A block 21 having a V-shaped notch 22 in its upper end is hingedly affixed to the flat body member 20 by a hinge 23 and it is thus movably positioned for movement between a horizontal position where it rests on the top of the flat body member 20 and the vertical position illustrated in the drawings.

A V-shaped cushion 24 is affixed in the notch 22 and a flat cushion 25 is affixed to the flat body member 20 inwardly of the other end thereof with respect to the block 21. Said other end of the flat body member 20 is formed with oppositely disposed cutaway areas 26. The secondary vertical support 11 comprises a pair of oppositely disposed angularly arranged frame members 27 and 28 respectively which are spaced with respect to one another at their upper ends a distance matching the width of the flat body member 20 between the cutaway areas 26 as heretofore described. Three secondary horizontal frame members 29, 30 and 31 are affixed to one side of the oppositely disposed angularly arranged frame members 27 and 28 and secondary horizontally disposed frame members 32 and 33 are affixed to the opposite sides thereof.

Figure 5:
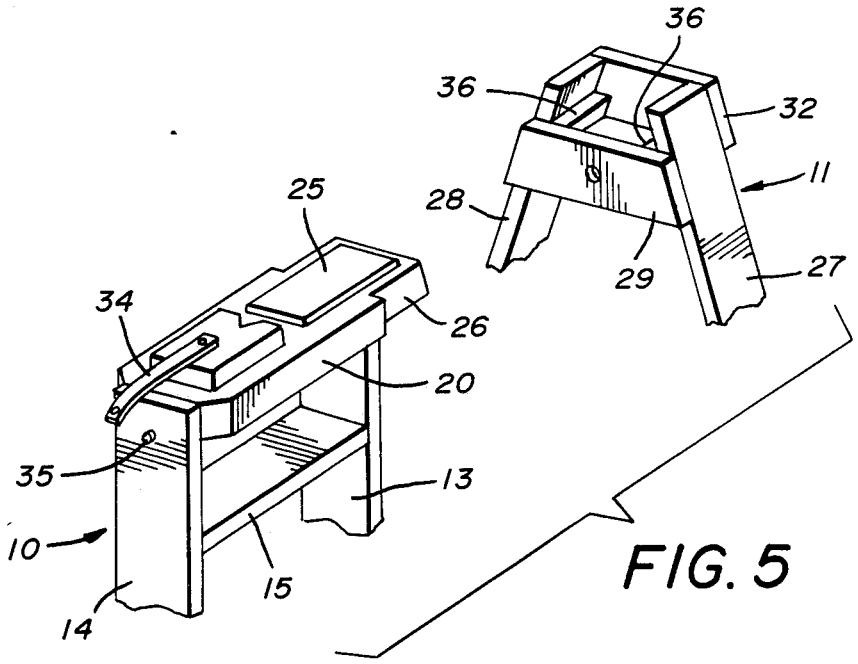
FIG. 5 is an enlarged detailed exploded elevation of portions of the shooting bench seen in FIGS. 1–4.

By referring again to FIG. 3 of the drawings and to FIGS. 4 and 5 of the drawings, it will be seen that a flexible strap 34 is attached to the front side, the right side as seen in FIG. 3, of the hinged block 21 and provided with a snap fastener 35, a portion of which is mounted on the front side of the frame member 14 so that as illustrated in FIGS. 1,2 and 3 of the drawings and in solid lines in FIG. 4 of the drawings, the hinged block 21 may be held in vertical position and thus serve as an effective, stable support for the barrel of a target pistol or other firearm when the butt or base of the grip of the firearm is resting on or spaced with respect to the cushion 25 on the flat body member 20 as will occur when the shooting bench is used in desirably positioning a target pistol in a target shooting contest.

Referring again to FIGS. 4 and 5 of the drawings, it will be observed that the extending end portion of the flat body member 20 having the cutaway oppositely disposed areas 26 will fit precisely within the open area defined between the upper ends of the oppositely disposed angularly arranged frame members 27 and 28 where it will rest on the horizontally disposed secondary frame member 29 and abut the secondary horizontally disposed frame member 32. A pair of oppositely disposed guides 36 are positioned on the inner sides of the frame members 27 and 28 with their upper surfaces in alignment with the upper surface of the horizontally disposed secondary frame member 29 so that the flat body member 20 is secured in fixed relation thereto.

Fasteners comprising nut and bolt assemblies 12 as hereinbefore described are then positioned through openings formed in the vertical frame member 13 and the horizontal frame members 29, 30 and 31 respectively to form the completely assembled shooting bench as illustrated in FIGS. 1,2 and 3 of the drawings.

It will occur to those skilled in the art that a small portable bench may be stored in the shooting bench disclosed herein as by affixing the same in upended position on the horizontally disposed frame member 16 of the vertical support 10 with the top of the bench adjacent to and temporarily fastened to the vertical frame member 14.

It will also occur to those skilled in the art that the area between the secondary horizontally disposed frame members 31 and 33 on the vertical support 11 may be provided with a bottom panel and a flexible top closure extending between the oppositely disposed angularly arranged frame members 27 and 28 to provide a closable receptacle.

It will further occur to those skilled in the art that apertures may be provided in the oppositely disposed angularly arranged frame members 27 and 28 of the vertical support 11 and in the secondary horizontal support 29 to which a flexible member such as a rope may be affixed to facilitate back packing the shooting bench if desired.

By referring again to FIGS. 1,2 and 3 of the drawings, it will be seen that each of the oppositely disposed angularly arranged frame members 27 and 28 are provided with adjustable legs 37 and 38 respectively adjacent their lowermost ends so that each of the three ground engaging parts of the shooting bench may be individually adjusted with respect to vertical elevation.

The above described structure provides relatively easy fast height adjustment of the platform level of the flattened body member 20 which is the effective top portion of the shooting bench. The structure is versatile in that it can be used on flat indoor or outdoor surfaces or on irregular or uneven or angularly disposed ground levels in outdoor target practice.

The formation of the shooting bench of two vertical supports as hereinbefore disclosed contibutes to the ease, simplicity and inexpensiveness of manufacture and the separate vertical supports when joined by the separable fasteners provide an unusually rigid and efficient shooting bench with an unusually stable top portion on which or on the hinge block attached thereto, the firearm is adjustably positioned.

Although but one embodiment of the present invention has been illustrated and described, it will be apparent to those skilled in the art that various changes and modifications may be made therein without departing from the spirit of the invention and having thus described my invention

What I claim is:

1. A shooting bench comprising a pair of vertical supports, one of which has vertical and horizontal frame members and a flat body member forming the top portion thereof and the other one of which vertical supports comprises a triangular frame unit having inclined oppositely disposed frame members and secondary horizontal frame members, means at the upper end of said other vertical support for receiving a portion of said flat body member forming the top of said first mentioned vertical support and a notched block mounted on said flat body member adjacent one end thereof oppositely disposed with respect to said other vertical support on which a target pistol or the like may be movably positioned and supported.

2. The shooting bench set forth in claim 1 and wherein said means at the upper end of said other vertical support for receiving a portion of said flat body member comprises a pocket defined by the upper ends of said inclined oppositely disposed frame members and one of said secondary horizontal frame members.

3. The shooting bench set forth in claim 1 and wherein a hinge secures said notched block to said flat body member and werein said notched block is movable from a first vertical position with said notch in its uppermost edge to a second horizontal position in engagement with said flat body member.

4. The shooting bench set forth in claim 1 and wherein a hinge secures said notched block to said flat body member and wherein said notched block is movable from a first vertical position with said notch in its uppermost edge to a second horizontal position in engagement with said flat body member and wherein flexible fastening means is attached to said notched block and detachably affixed to said one of said vertical supports having vertical and horizontal frame members.

5. The shooting bench set forth in claim 1 and wherein said vertical support having vertical and horizontal frame members is formed with said vertical and horizontal frame members defining a square frame when viewed in side elevation and wherein one of said vertical frame members is detachably engaged on at least a pair of said horizontally disposed secondary frame members of said triangular frame unit.

* * * * *